US010315820B2

(12) United States Patent
Smith

(10) Patent No.: US 10,315,820 B2
(45) **Date of Patent: *Jun. 11, 2019**

(54) DUAL ACTIVATION PACKAGE FOR READABLE CARD

(71) Applicant: Blackhawk Network, Inc., Pleasanton, CA (US)

(72) Inventor: Dennis Roy Smith, Minnetonka, MN (US)

(73) Assignee: BLACKHAWK NETWORK, INC., Pleasanton, CA (US)

( * ) Notice: Subject to any disclaimer, the term of this patent is extended or adjusted under 35 U.S.C. 154(b) by 15 days.

This patent is subject to a terminal disclaimer.

(21) Appl. No.: 14/629,148

(22) Filed: Feb. 23, 2015

(65) Prior Publication Data

US 2015/0232248 A1 Aug. 20, 2015

Related U.S. Application Data

(63) Continuation of application No. 12/187,208, filed on Aug. 6, 2008, now Pat. No. 8,960,433.

(Continued)

(51) Int. Cl.
*B65D 73/00* (2006.01)
*B65D 65/38* (2006.01)

(Continued)

(52) U.S. Cl.
CPC ..... *B65D 73/0085* (2013.01); *B65D 65/38* (2013.01); *B65D 73/0078* (2013.01);

(Continued)

(58) Field of Classification Search
CPC .... B65D 73/0078; B65D 2203/06; G09F 1/06

(Continued)

(56) References Cited

U.S. PATENT DOCUMENTS 1,187,258 A 6/1916 Carr et al.
4,615,480 A 10/1986 Powell (Continued)

FOREIGN PATENT DOCUMENTS

EP 2173636 B1 5/2012
JP 5193302 B2 5/2013
WO 2009021109 A1 2/2009

OTHER PUBLICATIONS

Filing receipt and specification for provisional patent application entitled "Dual Activation Package," by Dennis R. Smith, filed Aug. 7, 2007 as U.S. Appl. No. 60/954,471.

(Continued)

*Primary Examiner* — Robert Poon
(74) *Attorney, Agent, or Firm* — Wick Phillips Gould & Martin LLP; Jerry C. Harris, Jr.

(57) ABSTRACT

A package is configured to hold an information carrying card. The package includes a first panel connected to a second panel via a first fold line. The first panel includes a first opening. A third panel is connected to the second panel via a second fold line, the third panel includes a second opening. In a state where the first panel has been folded to overlap the second panel via the first fold line and the second panel has been folded to overlap the third panel via the second fold line, the first opening at least partially overlaps the second opening. The package may include a card on which data is stored. The data is exposed through the first and second opening to an environment outside the package.

11 Claims, 9 Drawing Sheets

Related U.S. Application Data

(60) Provisional application No. 60/954,471, filed on Aug. 7, 2007.

(51) Int. Cl.
*B65D 75/56* (2006.01)
*B65D 85/00* (2006.01)

(52) U.S. Cl.
CPC ..... *B65D 75/566* (2013.01); *B65D 85/70* (2013.01); *B65D 2203/06* (2013.01)

(58) Field of Classification Search
USPC ..... 206/307, 311–312, 472, 780, 779, 449, 206/461, 525.1, 806; 40/124.06; 229/92.3, 303–304; 283/61–62, 75, 82; 235/493, 486
See application file for complete search history.

(56) References Cited

U.S. PATENT DOCUMENTS

| | | | | |
|---|---|---|---|---|
| 4,746,019 | A | 5/1988 | Prater | |
| 5,791,474 | A | 8/1998 | Hansen | |
| 6,328,341 | B2 | 12/2001 | Klure | |
| 6,349,829 | B1 | 2/2002 | Matheis et al. | |
| 6,568,530 | B2 | 5/2003 | Takahashi et al. | |
| 6,644,473 | B2 | 11/2003 | Kohler | |
| 6,715,795 | B2 * | 4/2004 | Klure | B42D 15/025 206/38 |
| 6,948,742 | B2 * | 9/2005 | Buck | B42D 15/025 229/300 |
| 7,409,788 | B2 * | 8/2008 | Lauer | G06Q 99/00 40/124.01 |
| 8,898,939 | B2 * | 12/2014 | Kibbe | B42D 15/045 206/101 |
| 8,915,366 | B2 | 12/2014 | Smith | |
| 8,960,433 | B2 | 2/2015 | Smith | |
| 2002/0157974 | A1 | 10/2002 | Krahn | |
| 2003/0150762 | A1 | 8/2003 | Biller | |
| 2003/0230011 | A1 | 12/2003 | Mouyal | |
| 2005/0017502 | A1 | 1/2005 | Chariker | |
| 2005/0279825 | A1 * | 12/2005 | Ashby | B65D 27/14 235/380 |
| 2007/0045404 | A1 | 3/2007 | Andersen et al. | |
| 2007/0063021 | A1 * | 3/2007 | Chakiris | B42D 15/045 235/380 |
| 2008/0116089 | A1 * | 5/2008 | Roberts | B42D 15/042 206/232 |
| 2008/0190998 | A1 * | 8/2008 | Schulhof | B65D 5/0254 229/75 |
| 2011/0137793 | A1 * | 6/2011 | Liggett | G06Q 20/105 705/41 |
| 2012/0145578 | A1 * | 6/2012 | Pazlar | B65D 73/0078 206/459.5 |

OTHER PUBLICATIONS

Foreign communication from a related counterpart application—International Search Report and Written Opinion, PCT/US2008/072458, dated Nov. 12, 2008, 8 pages.
Foreign communication from a related counterpart application—International Preliminary Report on Patentability, PCT/US2008/072458, dated Feb. 9, 2010, 7 pages.
Foreign communication from a related counterpart application—Australian Office Action, Application No. 2008285415, dated Sep. 17, 2012, 4 pages.
Foreign communication from a related counterpart application—Canadian Office Action, Application No. 2,693,323, dated Jul. 17, 2014, 2 pages.
Foreign communication from a related counterpart application—Extended European Search Report, Application No. 08797369.9, dated Mar. 9, 2011, 5 pages.
Foreign communication from a related counterpart application—Mexican First Office Action, Application No. MX/a/2010/001455, forwarded from Mexican associate dated Sep. 5, 2012, 2 pages.
Foreign communication from a related counterpart application—New Zealand Examination Report, Application No. 582882, dated Jun. 10, 2011, 2 pages.
Foreign communication from a related counterpart application—New Zealand Examination Report, Application No. 582882, dated Sep. 6, 2012, 2 pages.
Foreign communication from a related counterpart application—New Zealand Examination Report, Application No. 603830, dated Nov. 29, 2012, 2 pages.
Foreign communication from a related counterpart application—New Zealand Examination Report, Application No. 603830, dated Apr. 15, 2013, 2 pages.

* cited by examiner

DUAL ACTIVATION PACKAGE FOR READABLE CARD

CROSS REFERENCE TO RELATED APPLICATIONS

This application is a continuation application of, and claims priority to, U.S. patent application Ser. No. 12/187,208 filed Aug. 6, 2008, which claims the benefit of U.S. Provisional Patent Application No. 60/954,471, filed Aug. 7, 2007, for DUAL ACTIVATION PACKAGE, the contents of which are incorporated herein by reference.

BACKGROUND OF THE INVENTION

Field of the Invention

This invention relates to multi-panel package, typically used to hold a card readable by a scanning device. In one example, the invention relates to a displayable package holding a card such as a prepaid phone or gift card.

Description of the Related Art

Various packages are available for displaying or holding cards used to carry magnetic or barcode information. Often, previous packages required removal of the card from the package prior to scanning. In some cases, the conventional packages allowed one type of scanning by a scanning device, but not another type, even if the card contained in the package included two types of scannable information.

There is a desire for a package in which the card may be scanned via a barcode reader when the package is completely closed, and the card may also be magnetically scanned as with a magnetic strip reader when the card is still attached to the package. Additionally, there is a need for a package that may be refolded and closed again without removing the card, after the card is scanned via a magnetic card reader.

SUMMARY OF THE INVENTION

Accordingly, one aspect of the invention includes a package configured to hold an information carrying card. The package includes a first panel connected to a second panel via a first fold line. The second panel includes a first opening passing through the second panel. The package includes a third panel connected to the second panel via a second fold line. The package also includes a fourth panel connected to the third panel via a third fold line. The fourth panel includes a second opening. In a state where the first panel has been folded to overlap the second panel via the first fold line, the second panel has been folded to overlap the third panel via the second fold line, and the fourth panel has been folded to overlap the third panel via the third fold line, the first opening at least partially overlaps the second opening.

For example, one non-limiting embodiment of the present invention can provide a package configured to hold an information carrying card including a first panel connected to a second panel via a first fold line. The first panel includes a first opening. The package includes a third panel connected to the second panel via a second fold line. The third panel includes a second opening, which, in a state where the first panel has been folded to overlap the second panel via the first fold line and the second panel has been folded to overlap the third panel via the second fold line, the first opening at least partially overlaps the second opening.

Another aspect of the invention includes a package system including a package holding a card on which information is recorded. The package includes a first panel connected to a second panel via a first fold line. The first panel includes a first opening. The package includes a third panel connected to the second panel via a second fold line. The third panel includes a second opening. The card on which information is recorded is removably attached to the first panel. While the package is in a folded state where the first panel has been folded to overlap the second panel via the first fold line and the second panel has been folded to overlap the third panel via the second fold line, the first opening at least partially overlaps the second opening. Information on the card is exposed to an environment outside the package system through the first opening while the package is in the folded state.

In one embodiment, the information on the card is recorded in the form of a barcode. The barcode is exposed from inside the package to an environment outside the package through the openings in the panels when the openings are aligned with each other.

Various modifications and variations of the present invention are possible in light of the above teachings. It is therefore to be understood that within the scope of the appended claims, the invention may be practiced otherwise than as specifically described herein.

BRIEF DESCRIPTION OF THE DRAWINGS

These and other advantages of the invention will become more apparent and more readily appreciated from the following detailed description of the exemplary embodiments of the invention taken in conjunction with the accompanying drawings where.

DETAILED DESCRIPTION

Figure 1A:
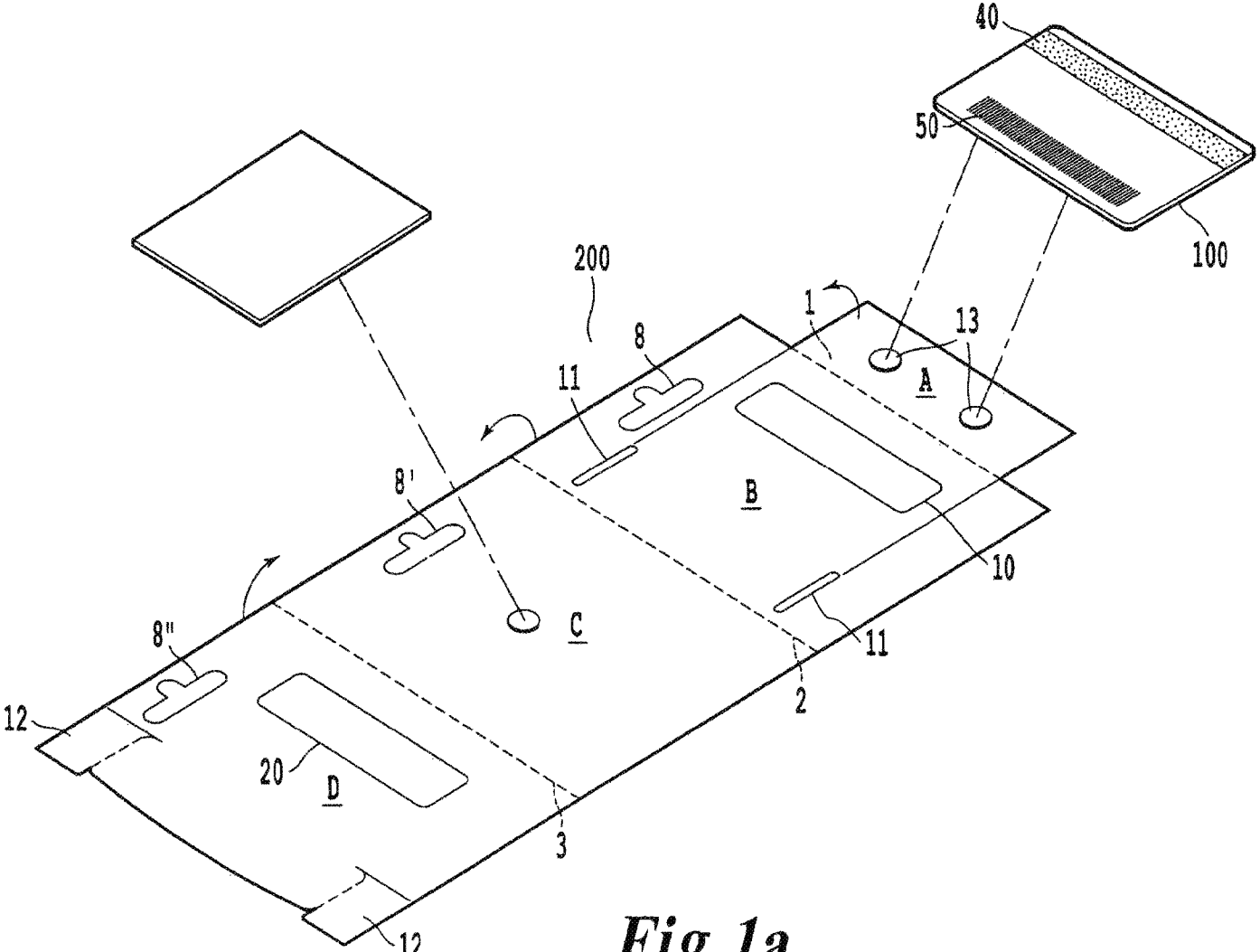
FIG. 1*a* shows an embodiment of the invention with a card and folded terms before attaching to the package, which includes four panels.

FIG. 1*a* describes one embodiment of a package designed for display and easy activation of a functional card, such as a phone or prepaid gift card by dual methods. One application of this embodiment includes the containment of secure open loop prepaid cards displayed in a retail environment.

The first method of card activation is via scanning a barcode on the card. The barcode is accessible through multiple die cut aligned windows in the package. The windows are aligned and oriented in such a way that the card can be scanned and activated while still securely held inside the package. This provides for a fast and easy checkout experience.

The second method of card activation includes opening the package and unfolding the panels to reveal a magnetic stripe on the card which can then be swiped to activate the card. The method to access the card involves:

1) breaking horizontal perforations and folding a rear panel of the package open from right to left;

2) breaking horizontal perforations on an interior panel and rolling the panel open from left to right, revealing the card itself affixed to an additional interior panel of the package;

3) swiping the card while it is still affixed to the package panel, and then rolling the panels closed to return it to the guest; and 4) resealing the package via tabs, which are attached to or are part of the package.

This embodiment of the package provides a solution for retail outlets that activate cards by either barcode or mag-stripe, thereby eliminating the need for maintaining an inventory of multiple package types. This embodiment also provides tamper evidence. By keeping the card securely glued to a package's panel up to, and through the process of activation, it is extremely difficult to compromise the package and remove the card without making the removal obvious and evident.

Various glues may be used, and the package itself may be made of paper, cardboard, tagboard, plastic, or foil, for example.

In the example of the invention is shown in FIG. 1*a* a card 100 is attached to the right-most portion of the paperboard package 200. The card 100 partially overlaps the package 200 and extends rightward away from the package 200 so as to expose a portion of the card 100 to a magnetic reader (not shown), which reads a magnetic strip disposed on the card 100. The paperboard package 200 folds as shown in FIG. 1*a* about fold line 1 such that a barcode 50 disposed on the card 100 aligns with opening 10 formed in panel B. Thus, panel A is folded against panel B, and the card is partially exposed through the opening 10.

Figure 1B:
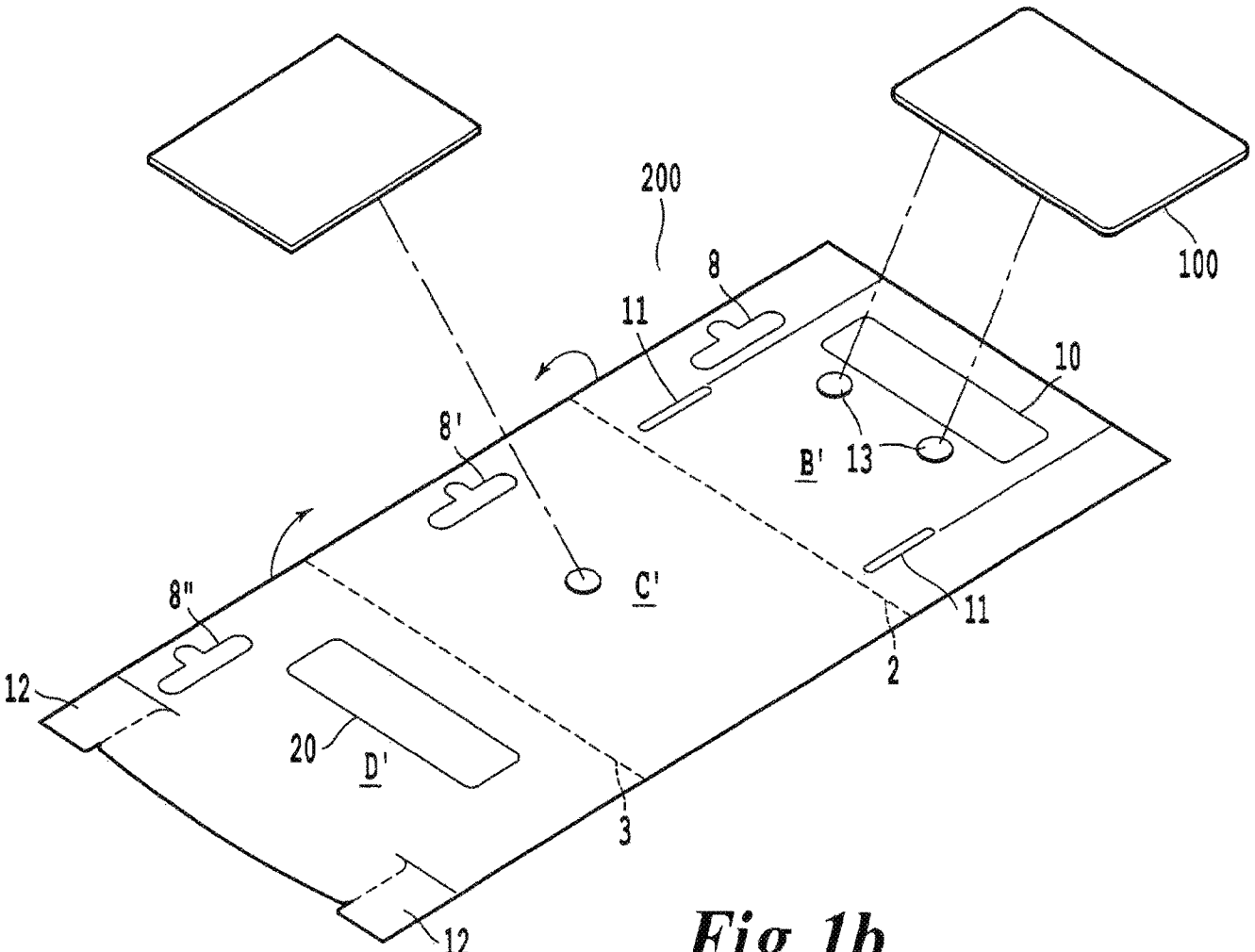
FIG. 1*b* shows an embodiment of the invention with a card and folded terms before attaching to the package, which includes three panels.

Panel B typically includes a "sombrero" 8 or hanger opening through which a peg may extend in order to support the paperboard package. As shown in FIGS. 1*a* and 1*b*, panels C and D may also include sombreros (8' and 8") so that, upon folding completely, the three sombreros overlap each other and allow a peg to extend through the completely folded paperboard package. In one non-limiting embodiment, the sombreros are sized so as to put forth a smaller sombrero for viewing by a potential customer while the package is hanging on a peg and to partially hide interior sombreros from view by making the interior sombreros larger than the exterior-most sombrero.

Panel B, after panel A is folded onto panel B, is itself folded onto panel C across fold line 2. Typically, the sombrero 8 in panel B will align with the sombrero 8' in panel C. Panel D will fold against panel C along fold line 3, and after folding is complete, only panel C will be visible from one side, and only panel D will be visible from the opposite side. Typically, the sombrero 8" will align with the sombreros 8 and 8'. A through-hole passing through panels B and D will be formed by the opening 20 and the opening 10 such that a portion of the card 100 (preferably the bar code 50) will be visible from the exterior when the package 200 is in the completely folded position. Preferably, the opening 20 in panel D will substantially overlap opening 10 in panel B in the folded condition. The term substantially overlap means that a majority of one hole is overlapped by the other hole such that the majority of the hole faces the area on the opposite side of the panel that defines the other hole. Thus, the information disposed on the card 100, such as a barcode 50, will be scannable from the card 100 even when the package 200 is in a completely closed position.

Panel B typically includes two elongated slots 11 through which tabs 12 disposed on panel D may be tucked when the package is in the folded condition so as to maintain the paperboard package in a folded position even after the perforated portions on panel D are torn away from the majority portion of panel D. In other words, the paperboard package may be maintained in a closed position after opening by using tabs 12 on panel D inasmuch as the tabs 12 can be tucked into the elongated slots on panel 2.

Typically, a contract or license agreement or perhaps instructions (Folded Terms) are attached to the interior surface of panel C via one or more glue dots as shown in FIGS. 1*a*, 1*b*, 2, 3*a*, and 3*b*. Various adhesives or other conventional bonding techniques may be used to attach the contract, license agreement, or instructions to the interior side of panel C, and the glue dot or dots used to adhere the Folded Terms can be of the same type as those used to adhere the card 100.

Various decorative or informative designs may be printed on individual panels. For example, on the exterior surface of panel C, pricing information or other instructions regarding use of the card may be displayed. Alternatively, or in addition to a display on panel C, the exterior surface of panel D may include attractive advertising designs.

One benefit of the above-noted arrangement is that the card 100 may be scanned via a barcode reader when the package 200 is completely closed, and the card 100 may be magnetically scanned as with a magnetic strip reader when the card 100 is still attached to the paperboard package. Additionally, the package 200 may be refolded and closed again without removing the card, once the card 100 is scanned via a magnetic card reader.

Although panel A is shown in FIG. 1*a* to be smaller than the panels C-D, other sizes of panels are possible. Furthermore, it is not necessary for the openings 10 and 20 to be identically sized. Rather, as discussed above regarding the sombreros 8'-8", it is possible to size one of the openings smaller than the other, such as for example, opening 20, so that the opening 10 will not unattractively overlap the opening 20 and expose an edge to a viewer of the closed paperboard package.

Figure 2:
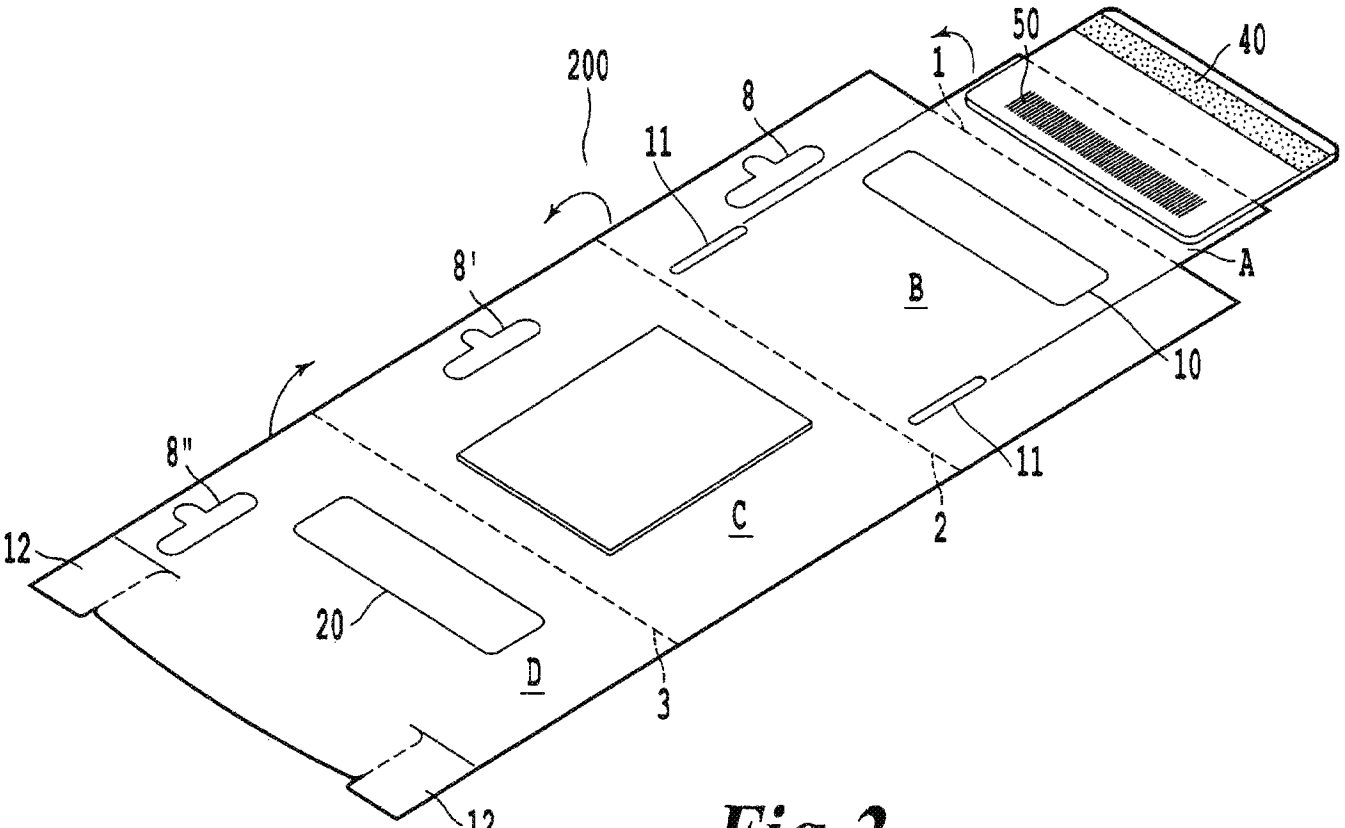
FIG. 2 shows the embodiment of FIG. 1*a* with the card and folded terms attached to the package when the package is in a completely unfolded state.

FIG. 2 shows the card 100 attached to panel A. Typically, the card 100 is attached to panel A via one or more glue dots 13. The glue dots 13 are typically made with a semi-permanent gel, rubber cement, or wax in order to allow a user to easily remove the card 100 without damaging it.

The fold lines 1-3 may be made via perforation or scoring, for example. Other methods are available.

Figure 3A:
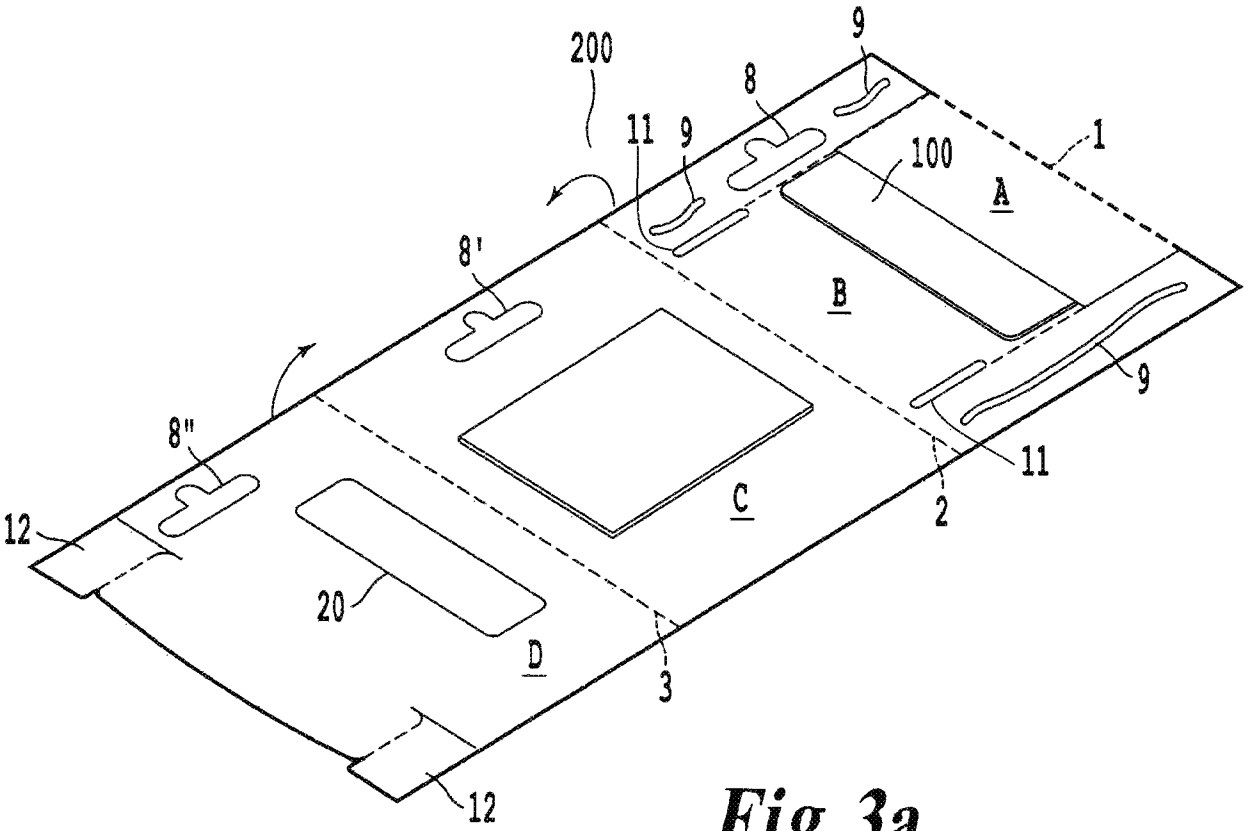
FIG. 3*a* shows the package of FIG. 2 with panel A folded upon panel B.
Figure 3B:
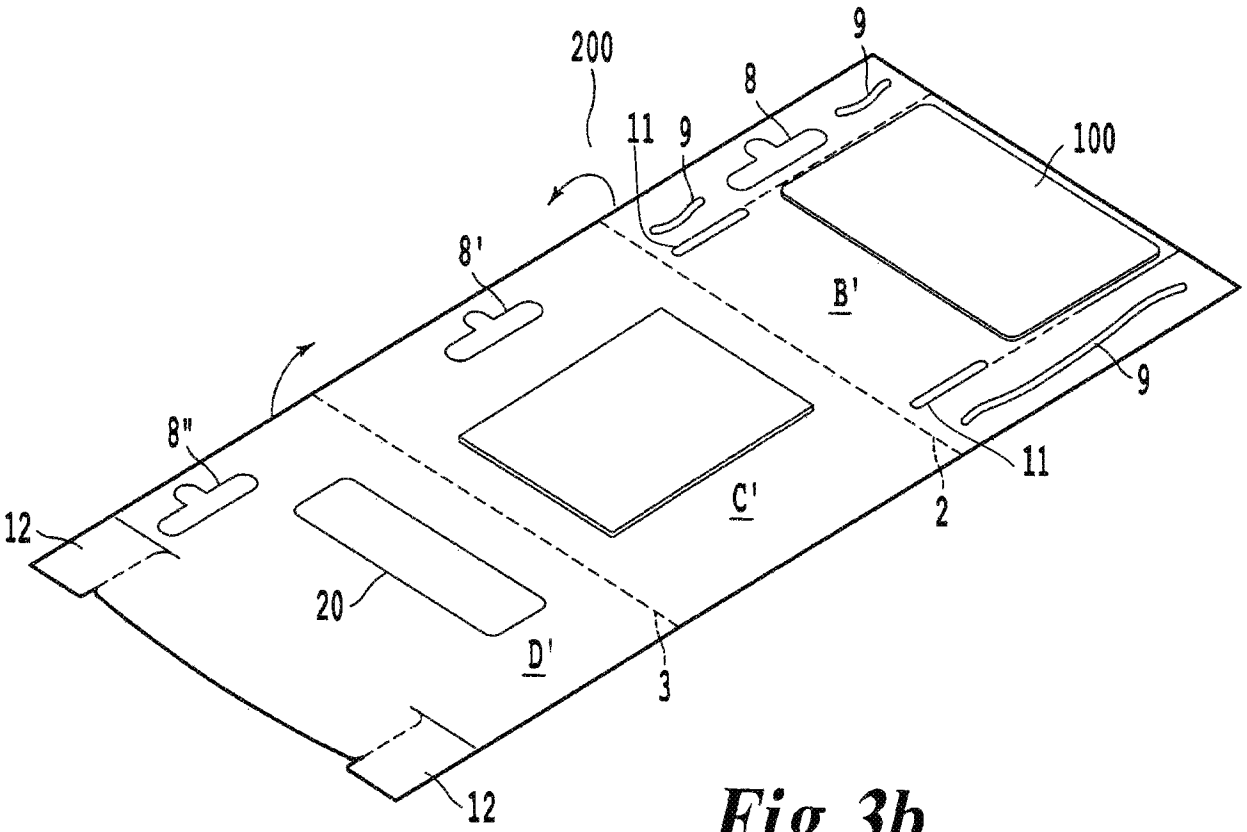
FIG. 3*b* shows the package of FIG. 1*b* with the card attached to panel B.
Figure 4:
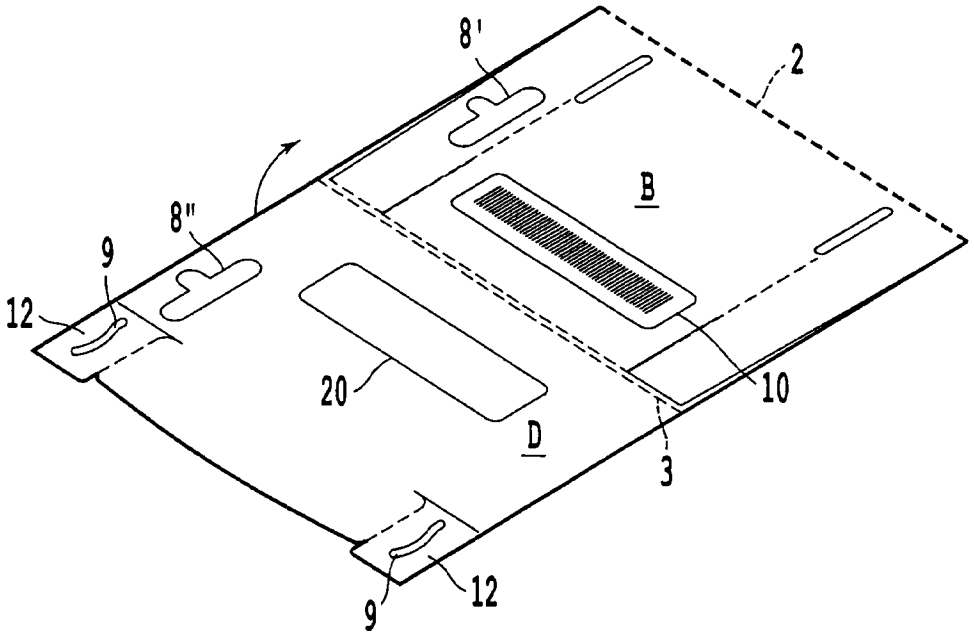
FIG. 4 shows the package of FIG. 3*a* with panel B folded upon panel C.
Figure 5:
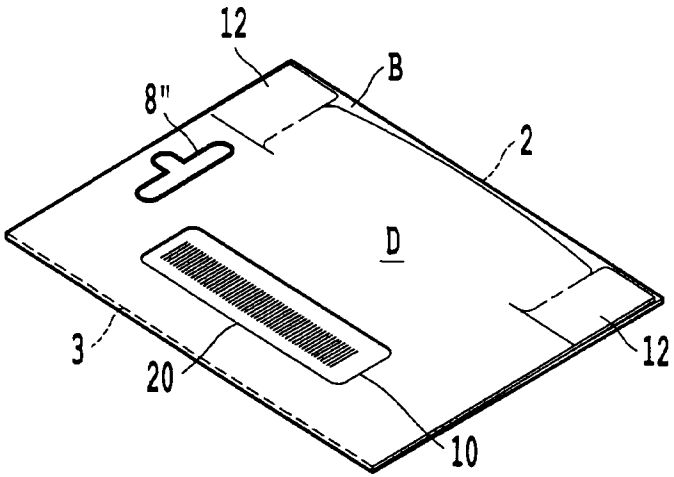
FIG. 5 shows the package of FIG. 4 in a completely folded state with panel D folded upon panel C after the package is folded as shown in FIG. 4.

FIGS. 3*a*, 3*b*, and 4 show locations of a permanent adhesive 9, which is applied during the initial folding of the package 200.

Figure 6:
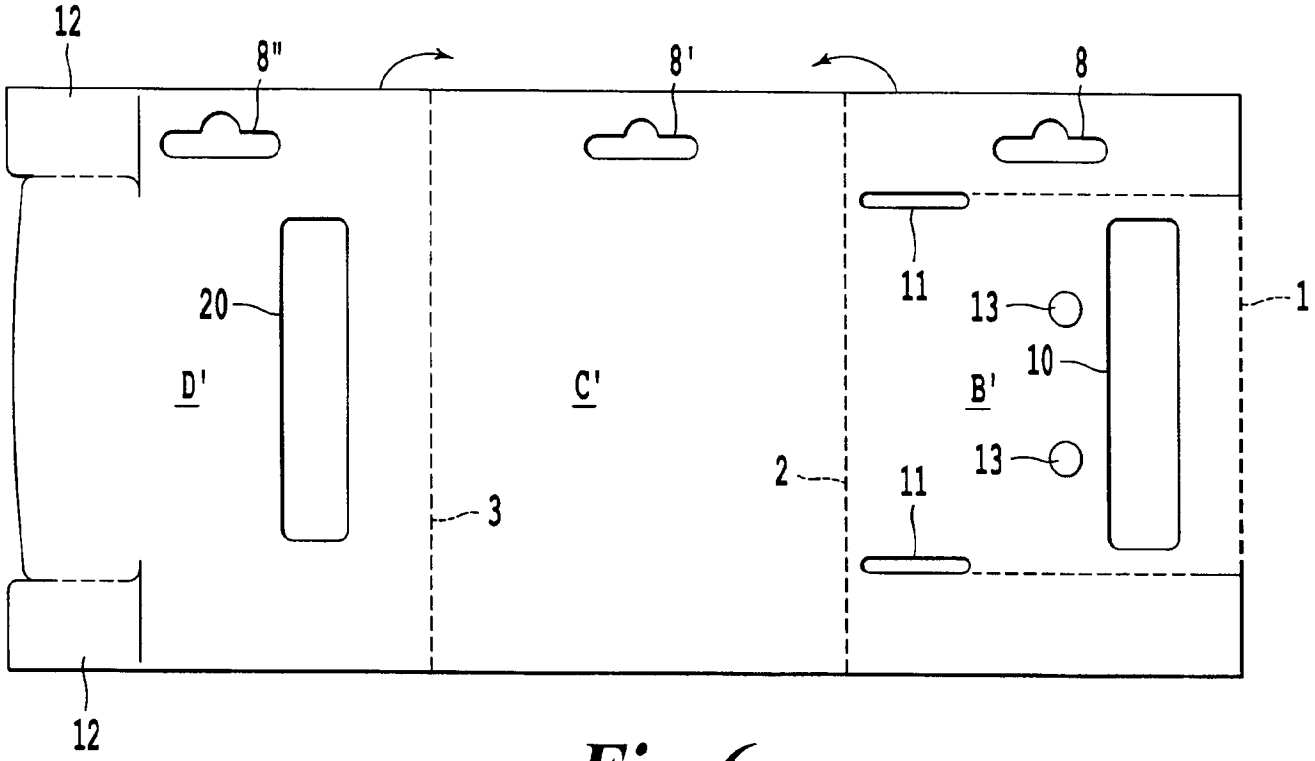
FIG. 6 shows another example of a package according to the invention.
Figure 7:
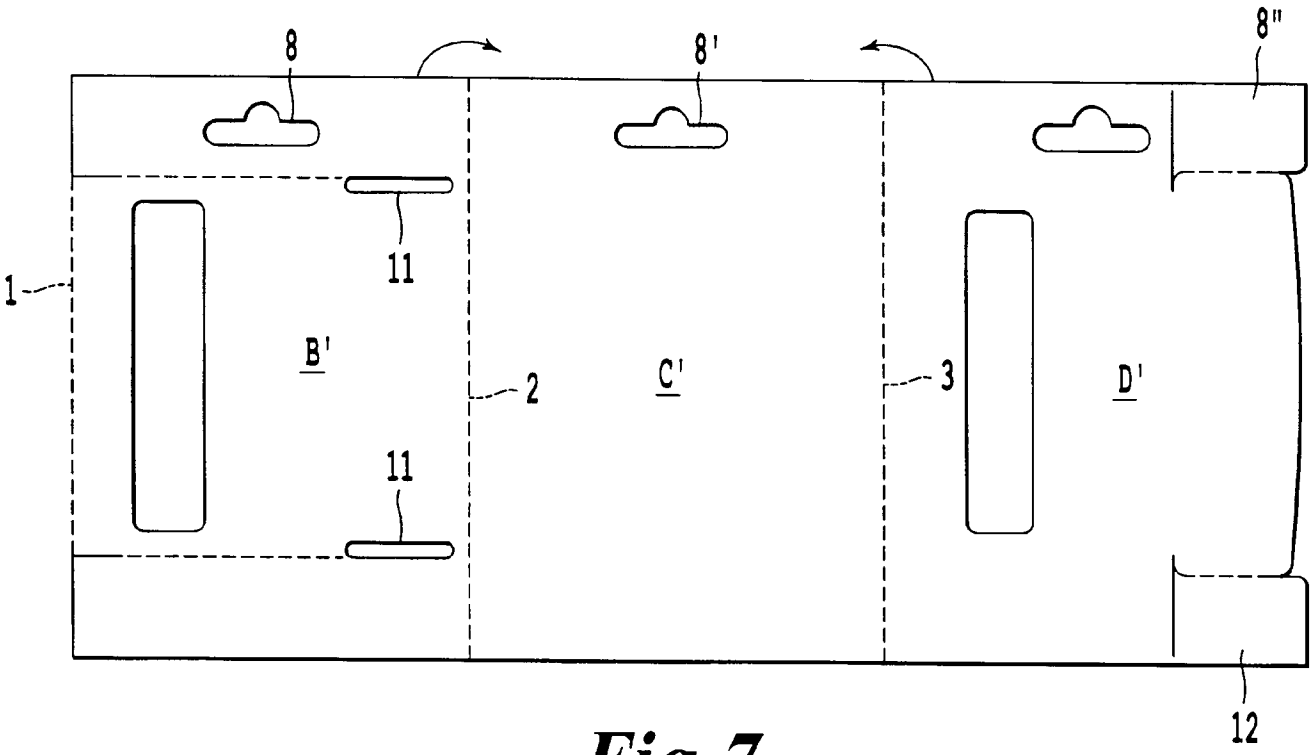
FIG. 7 shows a back view of the example shown in FIG. 6.

FIGS. 6 and 7 show one example of the variation of the invention depicted in FIG. 1*b* in which only three panels are provided, B', C', and D'. The panels B', C', and D' generally correspond to panels B, C, and D in FIG. 1*a*. Other reference numbers shown in FIGS. 6 and 7 correspond to the reference numbers used for the same items described with respect to FIG. 1*a*.

As shown in FIGS. 1*b*, 6, and 7, the card 100 is attached to panel B' rather than to a panel connected to panel B' on a side opposite panel C' as is the case in the example shown in FIG. 1*a*.

In the embodiment shown in FIGS. 1*b*, 6, and 7, the card 100 is removably attached to panel B' with a barcode 50 at least partially aligned with the opening 10 so that at least a portion of the barcode is exposed through the opening 10.

In a manner similar to the example shown in FIGS. 1*a*, 2, 3*a*, 4, and 5, the panels B', C', and D' shown in FIGS. 1*b*, 6, and 7 fold together such that the opening 10 at least partially overlaps the opening 20 on panel D'. The barcode 50 on the card 100 is then exposed through the overlapping openings 10 and 20 to allow a user to scan the barcode 50 with an appropriate scanner.

Although only certain embodiments of this invention have been described in detail above, those skilled in the art will readily appreciate that many modifications are possible in the exemplary embodiment without materially departing from the novel teachings and advantages of this invention. Accordingly, all such modifications are intended to be included within the scope of this invention.

I claim:

1. A multi-panel information carrying card holder system comprising:

a card on which information is recorded;

a first panel connected to a second panel via a first fold line, the first panel including a first opening and a first hanger opening and the second panel including a second hanger opening and removably attached folded terms, wherein the folded terms are centrally attached to the second panel; and a third panel connected to the second panel via a second fold line, the third panel including a second opening and a third hanger opening, which, in a state where the first panel has been folded to overlap the second panel via the first fold line and the second panel has been folded to overlap the third panel via the second fold line, the first opening at least partially overlaps the second opening which forms a through-hole which exposes information on the card to an environment outside the system and the first hanger opening, the second hanger opening, and the third hanger opening align to accept a multi-panel information carrying card holder support.

2. The multi-panel information carrying card holder system according to claim 1, wherein the third panel includes at least one tab, bounded, in part, by perforated portions of the third panel, the at least one tab extending to an edge of the third panel opposite the second fold line.

3. The multi-panel information carrying card holder system according to claim 2, wherein the first panel includes at least one elongated slot.

4. The multi-panel information carrying card holder system according to claim 1, wherein the first, second, and third panels comprise a paper product.

5. The multi-panel information carrying card holder system according to claim 1, wherein the first, second, and third panels comprise a plastic product.

6. A multi-panel information carrying card holder system comprising:

a first panel connected to a second panel via a first fold line, the first panel including a first opening and a first hanger opening and the second panel including a second hanger opening and removably attached folded terms, wherein the folded terms are centrally attached to the second panel, a third panel connected to the second panel via a second fold line, the third panel including a second opening and a third hanger opening; and a card on which information is recorded, the card being removably attached to the first panel, wherein while the system is in a folded state where the first panel has been folded to overlap the second panel via the first fold line and the second panel has been folded to overlap the third panel via the second fold line, the first opening at least partially overlaps the second opening which forms a through-hole which exposes information on the card to an environment outside the system and the first hanger opening, the second hanger opening, and the third hanger opening align to accept a multi-panel information carrying card holder support.

7. The multi-panel information carrying card holder system according to claim 6, wherein the third panel includes at least one tab, bounded, in part, by perforated portions of the third panel, the at least one tab extending to an edge of the third panel opposite the second fold line.

8. The multi-panel information carrying card holder system according to claim 7, wherein the first panel includes at least one elongated slot.

9. The multi-panel information carrying card holder system according to claim 6, wherein the first, second, and third panels comprise a paper product.

10. The multi-panel information carrying card holder system according to claim 6, wherein the card on which information is recorded includes a barcode and a magnetic portion, and the barcode and magnetic portion both include recorded information.

11. The multi-panel information carrying card holder system according to claim 10, wherein the information on the card exposed to an environment outside the system through the first opening while the system is in the folded state is information stored in the barcode.

* * * * *